US008478653B1

(12) United States Patent
Conway et al.

(10) Patent No.: US 8,478,653 B1
(45) Date of Patent: Jul. 2, 2013

(54) TAX-FREE GIFTING

(75) Inventors: David P. Conway, Los Altos, CA (US); Arun Balaraman, Cupertino, CA (US)

(73) Assignee: Google Inc., Mountain View, CA (US)

( * ) Notice: Subject to any disclaimer, the term of this patent is extended or adjusted under 35 U.S.C. 154(b) by 39 days.

(21) Appl. No.: 13/249,947

(22) Filed: Sep. 30, 2011

Related U.S. Application Data

(63) Continuation of application No. 13/076,867, filed on Mar. 31, 2011.

(51) Int. Cl.
*G06Q 30/00* (2012.01)

(52) U.S. Cl.
USPC ..... 705/26.1

(58) Field of Classification Search
USPC ..... 705/26–27, 26.1–27.2
See application file for complete search history.

(56) References Cited

U.S. PATENT DOCUMENTS

| | | | | |
|---|---|---|---|---|
| 7,108,171 | B1 | 9/2006 | Ergo et al. | |
| 2002/0019943 | A1 | 2/2002 | Cho et al. | |
| 2007/0255629 | A1 * | 11/2007 | Tillman | 705/26 |
| 2008/0066102 | A1 * | 3/2008 | Abraham et al. | 725/37 |
| 2008/0077950 | A1 | 3/2008 | Burke et al. | |
| 2011/0071924 | A1 * | 3/2011 | Desmond et al. | 705/27.1 |

OTHER PUBLICATIONS

Gonzalez, N., "gBox: Give the Gift of DRM-Free Music", Techcrunch.com, [online], Retrieved from the Internet: <URL: http://techcrunch.com/2007/08/21/gbox-give-the-gift-of-drm-free-music/>, (Aug. 21, 2007).

"Send Music, Videos, Audiobooks, and Apps as Gifts", iTunes Gift Options, iTunes / Apple.com, [online], Retrieved from the Internet: <URL: http://support.apple.com/kb/ht2736#4>, (May 2010).

Zibreg, C., "App gifting now possible in iTunes", Geek.com, [online], Retrieved from the Internet: <URL: http://www.geek.com/articles/mobile/app-gifting-now-possible-in-itunes-20100322/>, (Mar. 22, 2010).

* cited by examiner

*Primary Examiner* — Jeffrey A Smith
*Assistant Examiner* — Ethan D Civan
(74) *Attorney, Agent, or Firm* — Morris & Kamlay LLP

(57) ABSTRACT

A method includes receiving, from a computing device of a first party, a request to purchase a gift for a second party, identifying a location of the second party, determining whether a taxing authority of the second party's location imposes a tax on a purchase associated with redemption of the gift or a tax on the receipt of the gift, determining an amount of the tax imposed, generating a payment request for the gift including adding the amount of the tax to a cost of the gift, and transmitting the payment request to the computing device of the first party in response to the request to purchase the gift so that the first party has an option to pay the tax imposed based on the second party's location.

20 Claims, 15 Drawing Sheets

TAX-FREE GIFTING

CROSS-REFERENCE TO RELATED APPLICATION

This application is a continuation of U.S. application Ser. No. 13/076,867, filed Mar. 31, 2011, and entitled "Tax-Free Gifting," the entire contents of which are hereby incorporated by reference.

TECHNICAL FIELD

This patent application relates generally to gifting, and paying for, digital content, including media, such as audio and video.

BACKGROUND

A gift card is a type of token that may be given as a gift. Some types of gift cards, such as those provided by American Express®, are for a predefined dollar amount and may be used at any participating retailer. For example, a recipient may use such a gift card to purchase any goods or services up to the dollar amount from any participating retailer. Other types of gift cards may be specific to particular retailers. For example, a gift card for Banana Republic® entitles the recipient to purchase only items from Banana Republic® up to the dollar amount of the gift card. Still other types of gift cards entitle a recipient to receive a fixed amount of goods and services.

Different jurisdictions apply different amounts of tax to purchases made with tokens, such as gift cards. This cost of this tax is borne by the recipient of the token, and is typically paid when the token is redeemed.

SUMMARY

This patent application describes systems and techniques for gifting, and paying for, digital content, including media, such as audio and video.

Described herein is method performed by one or more processing devices, which includes receiving, from a computing device of a first party, a request to purchase a gift for a second party; identifying a location of the second party; determining whether a taxing authority of the second party's location imposes a tax on a purchase associated with redemption of the gift or a tax on the receipt of the gift; determining an amount of the tax imposed; generating a payment request for the gift including adding the amount of the tax to a cost of the gift; and transmitting the payment request to the computing device of the first party in response to the request to purchase the gift so that the first party has an option to pay the tax imposed based on the second party's location. The method may also include one or more of the following features.

Payment for a cost of the gift and the amount of the tax may be received at the same time. A cost of the gift may be received from the first party at a first time that the gift is purchased, and the amount of the tax may be received from the first party at a second, different time that the gift is redeemed.

The location of the second party may be identified based on at least one of an Internet Protocol (IP) address of a computing device of the second party, a known location of the second party, an e-mail address of the second party, a mobile phone number of the second party, contact information of the second party, or a SIM card value of the computing device of the second party.

The gift may include digital content. For example, the gift may include one of a digital asset that is redeemable online, a gift certificate, or currency. An offer to purchase the digital content may be made while media is being output. The request to purchase the gift may be received while the first party is experiencing media generated from the digital content. A user interface may be generated, which includes an option to purchase the gift. The user interface may be displayed on the computing device of the first party.

Identifying the location of the second party may include determining that the second party has accessed a location-specific virtual store. The payment request may include an option to pay the tax when the gift is redeemed.

Also described herein is a method performed by one or more processing devices, which includes presenting media content via an audio/visual display; presenting, at a point during presentation of the media content, an option to purchase the media content as a gift; in response to presentation of the option, receiving information for purchasing the media content as a gift for a recipient; issuing, to the recipient, a token that is redeemable to obtain the gift; and requesting payment for the gift, where the payment includes a cost of the gift and a tax imposed by a jurisdiction in which the token is redeemed. The method may also include one or more of the following.

Payment for the cost of the gift may be requested prior to issuing the token to the recipient. Payment for the tax may be requested at a time when the token is redeemed. Payment for the cost of the gift may be requested at a same time as payment for the tax.

The method may include identifying the jurisdiction based on information provided by a purchaser of the gift; obtaining a tax rate for the jurisdiction; and calculating an amount of the tax based on a tax rate for the jurisdiction and the cost of the gift. The method may include identifying the jurisdiction based on information associated with the recipient; obtaining a tax rate for the jurisdiction; and calculating an amount of the tax based on a tax rate for the jurisdiction and the cost of the gift.

All or part of the systems and techniques described herein may be implemented as a computer program product that includes instructions that are stored on one or more non-transitory machine-readable storage media, and that are executable on one or more processing devices. All or part of the systems and techniques described herein may be implemented as an apparatus, method, or electronic system that may include one or more processing devices and memory to store executable instructions to implement the stated functions.

The details of one or more implementations are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Described herein is a system for gifting, and paying for, digital content, including media, such as audio and video. The media content may include one or more digital assets, e.g., songs, movies, televisions shows, etc. In an example, the system presents media content via an audio/visual display, and presents, at a point during presentation of the media content, an option to purchase the media content as a gift. The system receives information for purchasing the media content as a gift for a recipient, and issues a token to the recipient, which is redeemable to obtain the gift. Payment is then requested for the gift. The payment includes a cost of the gift and a tax imposed by a jurisdiction in which the token is redeemed. By paying the tax when the gift is purchased, tax-free gifting occurs, relieving the gift recipient of the need to pay the tax on the gift.

Other types of gifting can include, for example, giving someone a digital asset (e.g., a copy of a song or movie), a suggestion for a digital asset along with the price and expected taxes, or a gift certificate along with the expected taxes to cover the purchases made with the gift certificate, to name a few examples. In some implementations, gifting can include giving the gift recipient actual money for physical purchases at retail. In this case, the money provided could be increased to cover the amount of the tax. In some implementations, gifting can be made using electronic payment available to or through wallet functions or other payment functions on mobile devices, e.g., where recipients can swipe their mobile devices to pay for things at retail. In this case, the gifting can credit an amount to a recipient's device (e.g., a smart phone, etc.), including the value of the gift and associated taxes.

Figure 1:
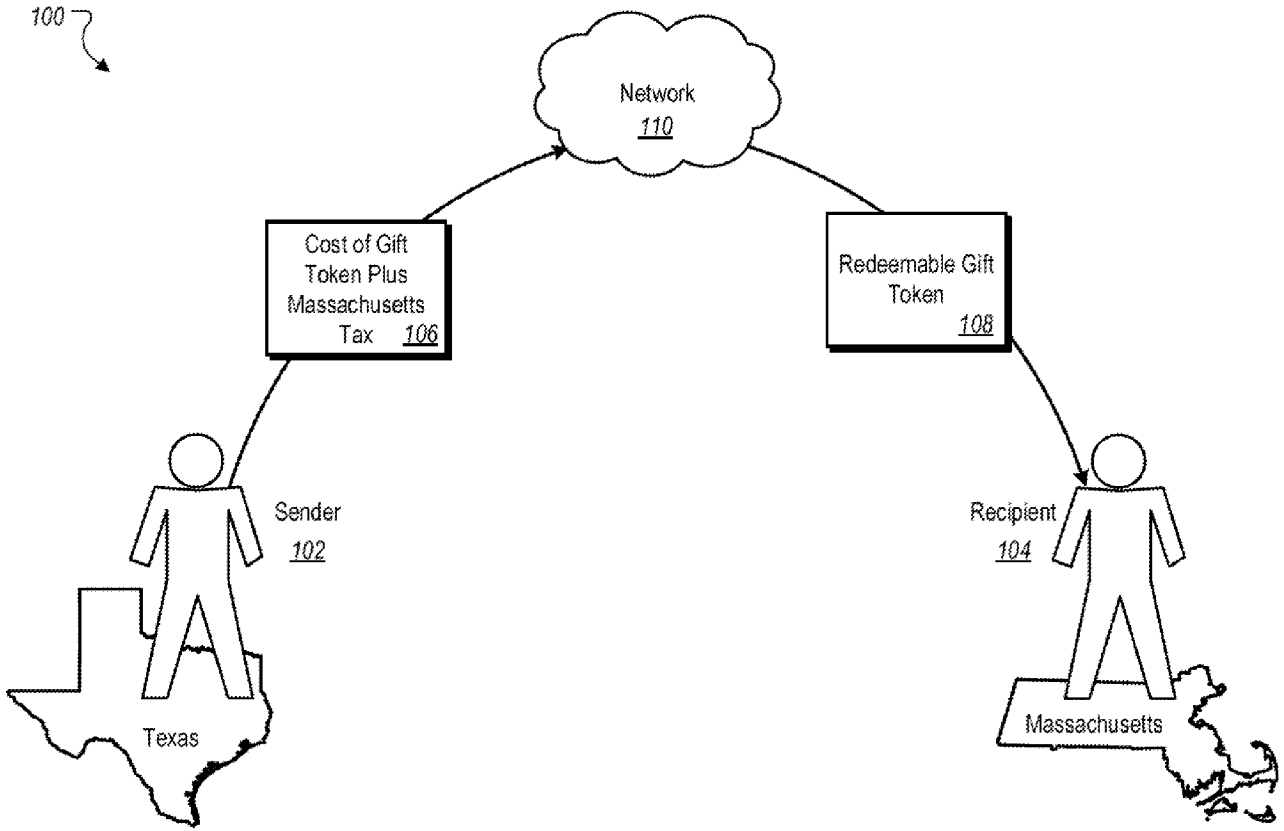
FIG. 1 is a block diagram that shows an example system for tax-free gifting.

FIG. 1 is a block diagram that shows an example system 100 for tax-free gifting. Using the system 100, for example, a first party in a first location can purchase, and pay the associated tax amount for, a gift for a second party in a second location. The system 100 can include one or more computer systems with which the first party (e.g., a user) can communicate and complete the gift-giving process. For example, the user can use a personal computer, a laptop, or a smartphone or other mobile computing device.

In the example shown in FIG. 1, the first party is a sender 102 in Texas who is sending a gift (e.g., a gift card) to the second party, a recipient 104 in Massachusetts. When buying the gift (e.g., online), the sender 102 can provide sender information and recipient information, as well as payment information, to buy the gift. In some implementations, during the same communication in which the user buys the gift, the sender 102 can also pay the amount of the tax or taxes on the gift. By paying the applicable tax(es) on the gift, for example, the sender 102 can make the full value of the gift (e.g., three song downloads, $50 gift card, etc.) available to the recipient 104. As a result, the recipient 104 can receive a gift token that represents the full value of the gift, e.g., a gift token that is redeemable online.

The terms sender 102 and recipient 104 when used in this document can represent the computing devices with which individuals (who are senders and recipients of gifts) can be connected to the Internet. In some cases, the use of the terms can also imply sender and recipient actions on those computer devices, such as the payment of a tax amount for a gift.

In some examples, the taxes can be imposed upon redemption of a gift or upon receipt of the gift. The taxing authority (e.g., government) may impose the tax based on the location of the recipient. Taxes can vary by jurisdiction, such as for different geographic locations or areas. The taxes imposed for the gift can be based on the address (e.g., the city and state) of the recipient 104. For example, the sender 102 can specify the address of the recipient 104 when purchasing the gift and paying the amount of the tax, and the jurisdiction can be extracted automatically from the address (e.g., from the name of the city in which the recipient lives). Example taxes that the sender 102 can pay can include combinations of state and local sales tax, value added tax (VAT), provincial sales tax (PST), and goods and services tax (GST), to name a few examples. In any one location, more than one tax can apply. For example, places in Massachusetts (or in other states) can impose combinations of a state sales tax, a county tax and a city tax. In some cases, a jurisdiction may have no tax at all, e.g., a state with no sales tax, or a duty-free store in an airport or near a border. In some cases, a web site or online merchant may not impose a sales tax unless the recipient 104 is a resident of that state (e.g., "Massachusetts residents must add 6% sales tax"). Therefore, the system 100 can determine if a tax is owed, and if so, allow for the sender 102 to pay the amount of the tax.

As an example of paying the tax, when the sender 102 buys the gift for the recipient 104 in Massachusetts, a total price 106 that the sender 102 pays can include the cost of the gift plus the amount of Massachusetts tax. The tax in this case corresponds to the jurisdiction (e.g., Massachusetts, or a city in Massachusetts) that is associated with the recipient 104. For example, Massachusetts tax can be included in the total price 106 because, at the time that the sender 102 buys the gift (e.g., online), the sender 102 can identify Massachusetts as the place that the recipient 104 lives (or plans to redeem the gift token for the gift). Upon completion of the sender 102 purchasing the gift and paying the tax, the recipient 104 can receive a redeemable gift token 108 that represents the gift. Payment of the total price 106 and receiving the redeemable gift token 108 can occur over a network 110, such as one or more of the Internet, local area networks (LANs), wide area networks (WANs), other wireless and wired networks, or combinations thereof.

The gift card that the sender 102 in Texas is gifting to the recipient 104 in Massachusetts is just one example of a gift token that can represent the value of a gift. Other gift tokens can include, for example, redemption codes, promotion codes, account numbers, clickable links to a redemption web site, or any other identifier that the recipient 104 can use to redeem the gift token online. Alternatively, gift tokens that may be usable instead, or additionally, at a physical brick-and-mortar location can include, for example, value-loaded debit cards, coupons, gift certificates, or any other tangible token of value. Some gift tokens can be used either online or at physical brick-and-mortar locations. In some implementations, gift tokens can exist entirely online (e.g., redemption codes) without the need to produce or print a physical gift token.

In some implementations, instead of paying the tax at the time that the gift is purchased, the sender 102 can pay the amount of the tax later on. In this regard, the sender 102 may be provided with a payment request upon purchase of the gift. The payment request may include payment for the gift and the tax imposed in the jurisdiction where the gift is redeemed or received. The payment request may include an option to pay the tax now or at a later time (e.g., when the gift is redeemed). For example, the sender 102 can pay the tax amount later when the gift token is eventually redeemed by the recipient 104, which may be hours, days, weeks or months later. In this case, the tax can simply be charged to the sender's account or credit card at redemption time. For example, the identification of the sender's account and/or credit card information can be maintained on file, such as at a central server. Paying the amount of the tax at redemption time can provide the advantage of allowing the recipient 104 to use the gift token in any jurisdiction, including a jurisdiction other than the location at which the recipient 104 lives. Delaying payment of the tax amount until redemption time can also provide the benefit of preventing the sender 102 from paying the wrong amount, e.g., pre-paying tax for what turns out to be the wrong jurisdiction.

The jurisdiction for which to pay taxes can be determined in other ways. For example, in some implementations, the sender 102 can choose the recipient 104 from the sender's 102 address book. Using the address stored there, for example, the jurisdiction can be determined from any one or combinations of the ZIP code, city, state, country, etc.

In some implementations, the sender 102 can enter a city name, such as can be entered on common GPS systems, and the specific jurisdiction(s) corresponding to the city name can be determined automatically (e.g., as a table look-up, etc.). In situations in which the city name that is entered is ambiguous (e.g., Springfield), the system can prompt the user for additional input (e.g., to designate the state as MA, IL or MO, etc.). To avoid being prompted for the state, for example, the user can include the state name when entering the city name.

In some implementations, the jurisdiction can be determined from other information that is known for the recipient 104. As an example, if the recipient's email address is known, then the jurisdiction can be determined from the IP address from which the recipient 104 typically logs in for email. In some implementations, the jurisdiction can be determined from a known location for the recipient 104, such as if the recipient 104 has stored a location with the email account (e.g., when the email account is registered).

In some implementations, the jurisdiction can be determined using available knowledge of the recipient's mobile phone number or SIM card values from past online interactions or through messages exchanged with the sender 102. For example, determining the jurisdiction can use the area code and/or local exchange of the recipient's phone number instead of requiring the contact information for the recipient 104 to include a city and state.

FIGS. 2 through 9 collectively show an example system 200 and sequence of events for tax-free gifting. FIGS. 2 through 9 also collectively show the system 200 as providing an example hardware flow and architecture for gift-buying and the payment of the amount of tax. For example, the system 200 can be used to purchase, and pay the tax for, a gift of online media, such as digital content (e.g., an online movie) that may be purchased while viewing the online media (e.g., an online movie).

Figure 2:
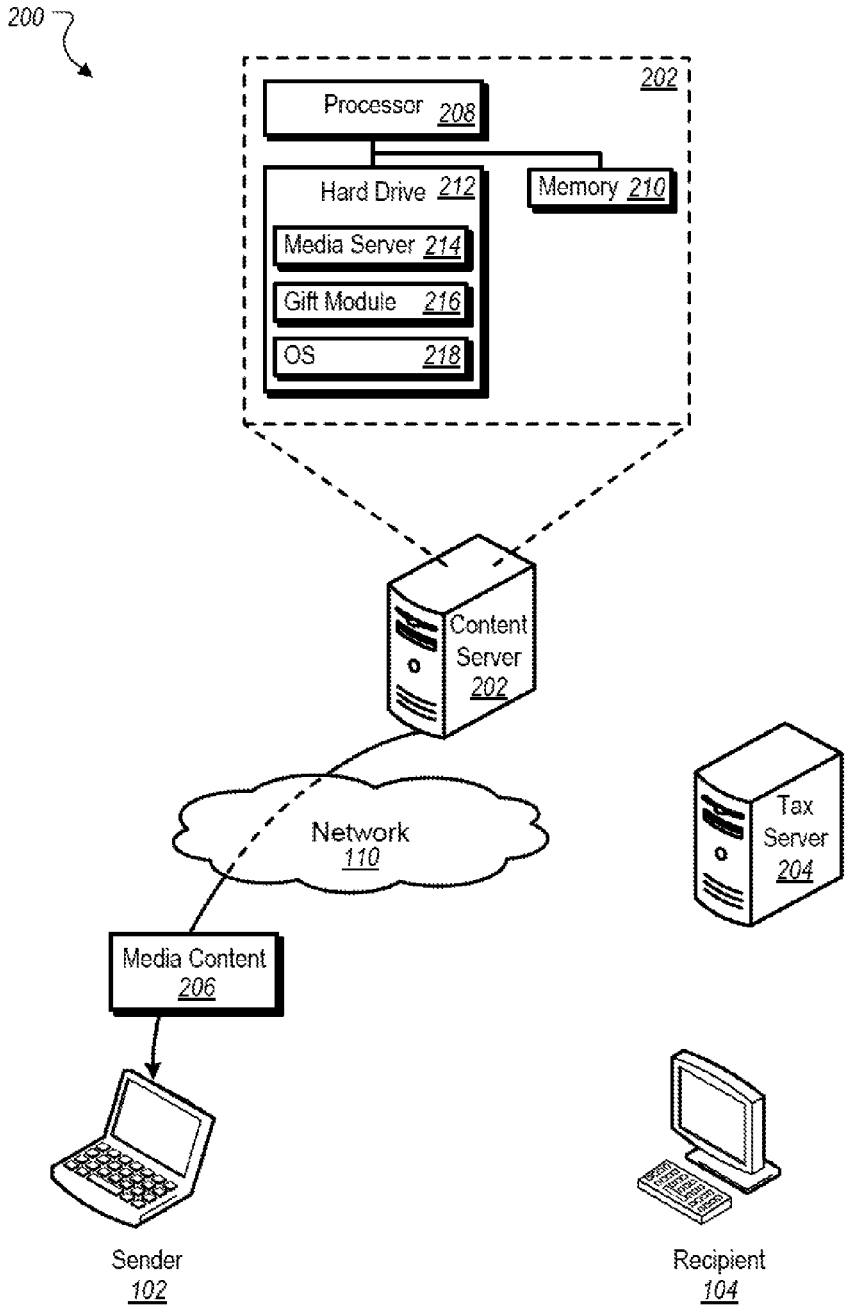
FIGS. 2 through 9 collectively show an example system and sequence of events for tax-free gifting.
Figure 3:
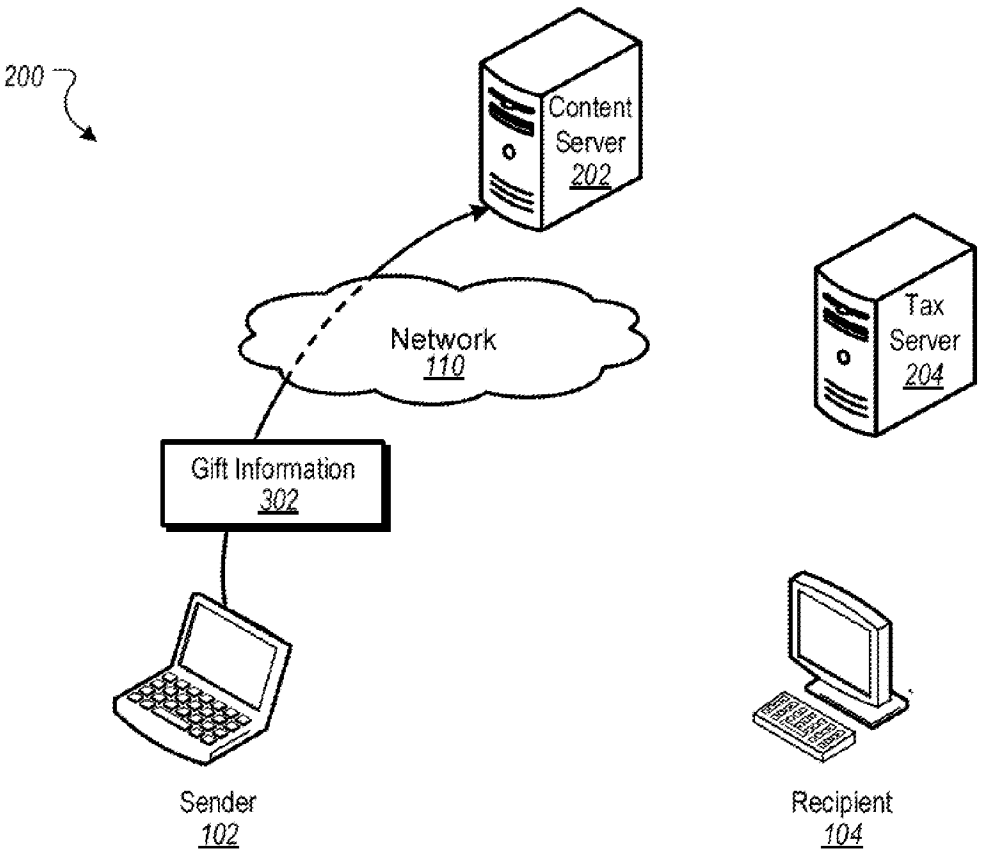

Referring to FIG. 2, the system 200 includes at least one content server 202 for serving digital content from one or more online resources, and at least one tax server 204 for computing the tax amount on media content 206 that is provided by the content server 202. The network 110 can connect the content server 202 and the tax server 204 with any number of senders 102 and recipients 104.

For example, the content server 202 can operate as a data and communication server for one of several web sites that serve content to online users, such as the sender 102. Example web sites can include online movie clearinghouses, online movie rental web sites, online audio content stores, and so on. The web sites can interact with other servers connected using the network 110, such as the one or more tax servers 204, each of which can host a separate web site. Users such as senders 102 can interact with the web sites, using the network 110, to review media content (e.g., media content 206), to select and purchase digital content, and to pay tax on the purchases. Users such as recipients 104 can interact with the web sites, using the network 110, to receive gift tokens, and to redeem the gift tokens.

In some implementations, the content server 202 includes a processor 208 communicatively coupled to memory 210 and a hard drive 212. The processor 208 can process instructions (e.g., stored in the memory 210) for execution within the content server 202. The hard drive 212 can store data instructions for a media server 214 for providing media to users, a gift module 216 for handling media gift-giving transactions, and an operating system 218 for executing applications on the content server 202.

The media server 214, for example, can include applications that serve online media for viewing. For example, the media server 214 can be the component of the content server 202 that primarily provides the media content 206 (e.g., part or all of an online movie, a downloadable song, etc.) to the sender 102.

The gift module 216, for example, can make digital content (e.g., a downloadable movie or song, etc.) available for gifting (e.g., by the sender 102). The gift module 216 can handle transactions for gifting the digital content to others (e.g., by the recipient 104), and allow for payment of the amount of tax (e.g., by the sender 102) that is applicable to the gift.

For example, the act of the sender 102 receiving the media content 206 from the content server 202 can be the first in a sequence of events for tax-free gift giving. The remaining actions, for example, are shown in FIGS. 3-9.

Figure 10:
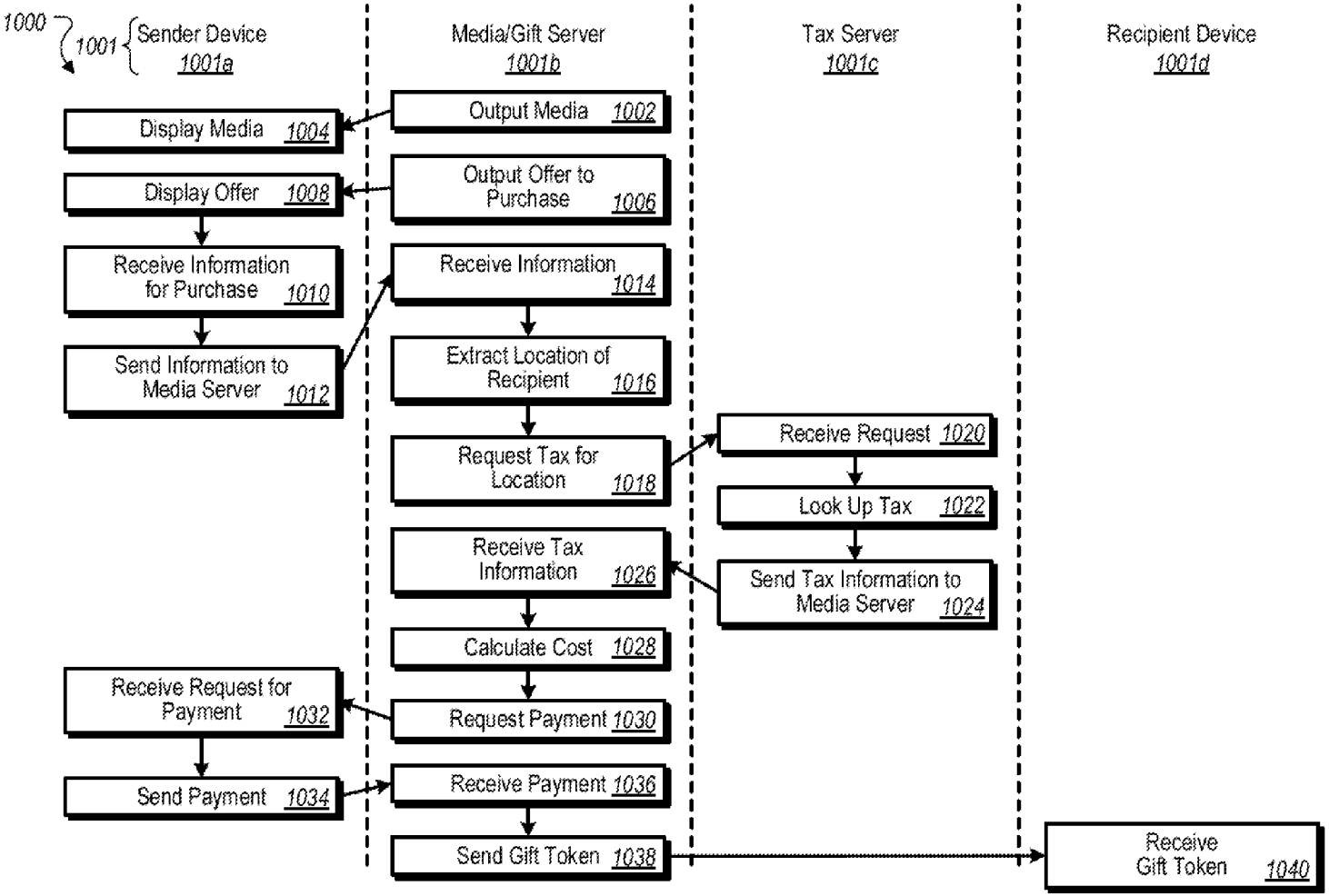
FIG. 10 is a swim-lane diagram of an example process for tax-free gifting.

FIG. 10 is a swim-lane diagram of an example process 1000 for tax-free gifting. For example, the process 1000 can be used by a user, such as the sender 102, to buy a gift (e.g., video, audio or other digital content) for the recipient 104, and to pay the amount of the tax for the gift.

FIG. 10 shows lanes for steps that can be performed by entities 1001, including a sender device 1001*a*, a media/gift server 1001*b*, a tax server 1001*c*, and a recipient device 1001*d*.

Media is output (1002), e.g., by the media/gift server 1001*b*. Referring to FIG. 2, for example, the media that is output can be the media content 206 (e.g., an online movie) that the content server 202 provides to the sender 102. For example, a user can receive the media on a portable computing device (e.g., a smartphone).

The media is displayed (1004), e.g., by the sender device 1001*a*. As an example, the sender 102 can view the media content 206 (e.g., the online movie), using a media player application or other application that is compatible with the format of the media content 206. The user may decide to view the media content 206, for example, for pleasure or to determine if the digital content on which the media content 206 is based would make a good gift.

An offer to purchase the media is output (1006), e.g., by the media/gift server 1001*b*. For example, after the sender 102 has played a portion of the movie, thus indicating a likely interest, the content server 202 can send an offer to the sender 102.

The offer is displayed (1008), e.g., by the sender device 1001*a*. For example, the sender 102 can display the offer, such as on the screen of a laptop computer or other computing device. In some implementations, the offer can include a message inquiring whether the sender 102 wishes to send the movie as a gift. For example, the message can appear as an overlay (e.g., on the same screen) on the movie as it is playing on the screen of the sender 102. In some implementations, when a purchase offer or message is displayed, the media content 206 can temporarily pause. In this way, the user can view the offer and either accept or dismiss the offer without missing parts of the media content 206.

The information for the purchase is received (1010), e.g., by the sender device 1001*a*. For example, using user interfaces of the sender 102, a user can provide information that is needed to complete the purchase transaction, including information identifying the sender 102 and the recipient 104. For example, the information can include names, street addresses, email addresses and phone numbers for the sender 102 and the recipient 104, as well as payment method information (e.g., credit card, bank account, etc.) for the sender 102.

The information is sent to the media server (1012), e.g., by the sender device 1001*a*. For example, referring to FIG. 3, the sender 102 can provide gift information 302 to the content server 202. If the content server 202 is a web site, for example, sending the information can occur when a "Place Order" control is selected by the user, such as after the sender, recipient and payment information has been provided.

The purchase information is received (1014), e.g., by the media/gift server 1001*b*. For example, the content server 202 can be a digital content web site that receives orders from customers (e.g., senders 102) over the network 110 (e.g., the Internet). The information received can include the recipient's location, including an address, and other information.

The location of the recipient is extracted (1016), e.g., by the media/gift server 1001*b*. The location that is extracted, for example, can correspond to a city, state or region that can be used to determine a tax amount for the gift being purchased. For example, referring to FIG. 2, one or more location-determining functions of the gift module 216 can determine the location of the recipient 104. Determining the location can be as simple as accessing the name of the city and state of the recipient 104 that was supplied by the sender 102.

In some cases, to get an accurate location for determining a tax jurisdiction, a street number may need to be accessed from the information provided by the sender 102. This is because some cities can have regions of their city in different counties, and not all ZIP codes follow city boundaries, to name a few examples.

The amount of the tax for the location is requested (1018), e.g., by the media/gift server 1001*b*. As an example, referring to FIG. 4, the content server 202 can provide a request 402 to the tax server 204 for the amount of tax for the gift. The request can be in the form of supplying any combination of location information, including street address, ward, city, county, state, country, province, territory, ZIP code, etc. Any pieces of information supplied with the request can be used to identify the tax jurisdiction associated with the recipient 104.

The request is received (1020), e.g., by the tax server 1001*c*. For example, the request 402 can be received by a tax server 204 that may be, for example, an online agency or repository for identifying tax rates for certain jurisdictions. In some implementations, the content server 202 can maintain a cache of tax rates for jurisdictions in order to make tax rate look-ups more efficient. In this case, the tax server 204 can send (or be requested to send) periodic updates to the content server 202 in order to keep the tax rates up-to-date.

Figure 4:
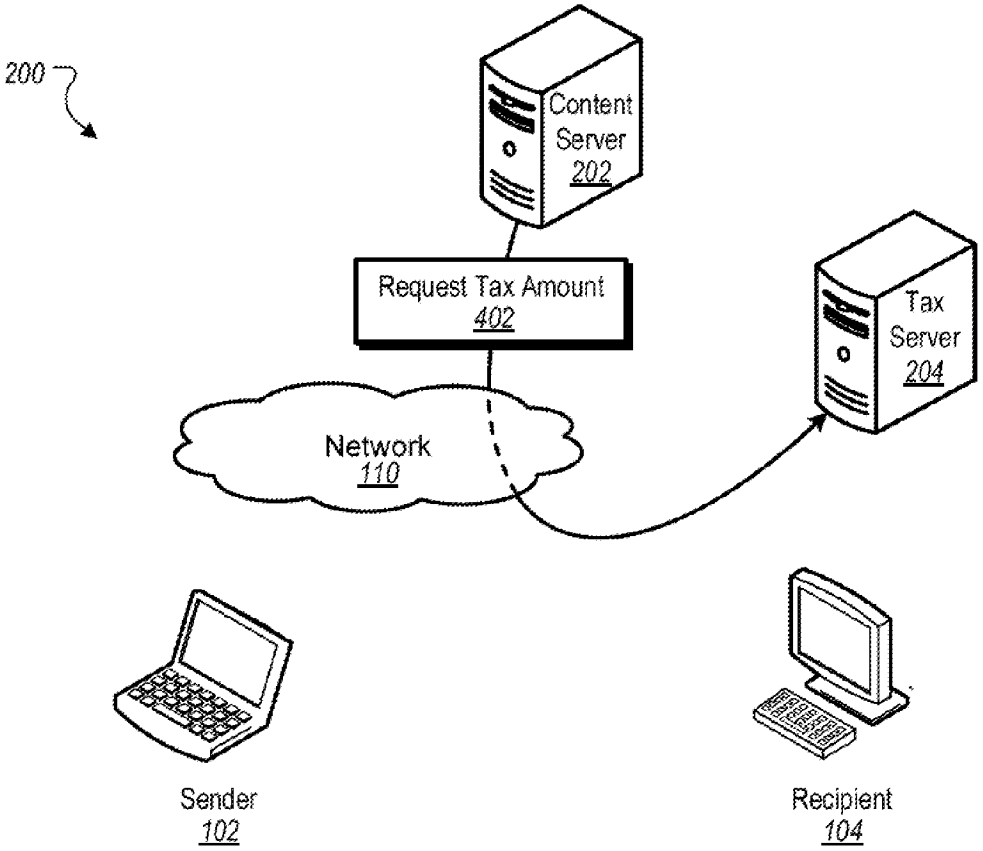
Figure 5:
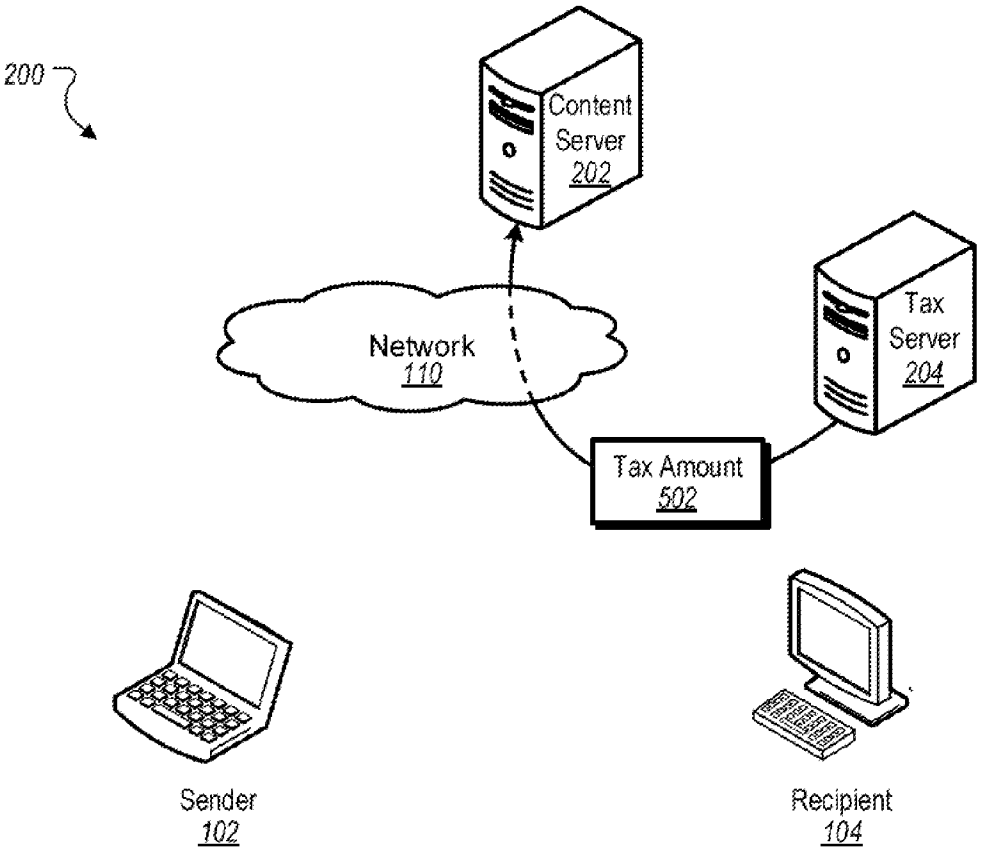
Figure 6:
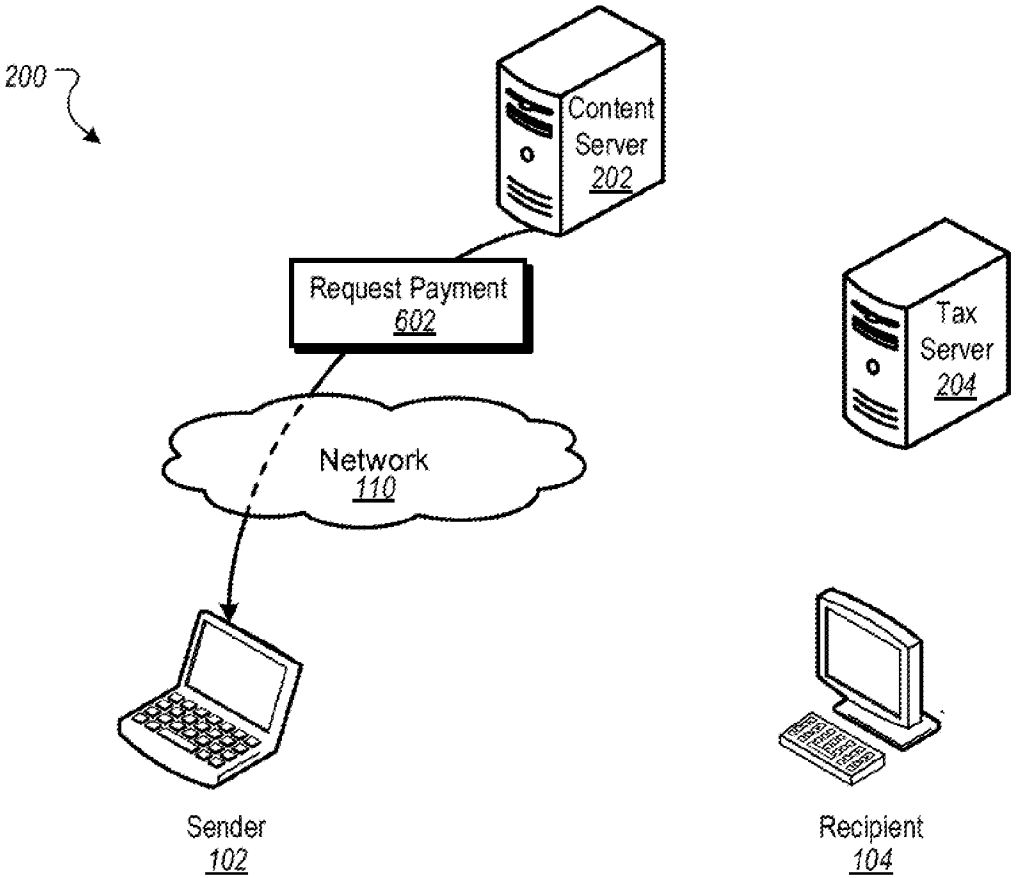
Figure 7:
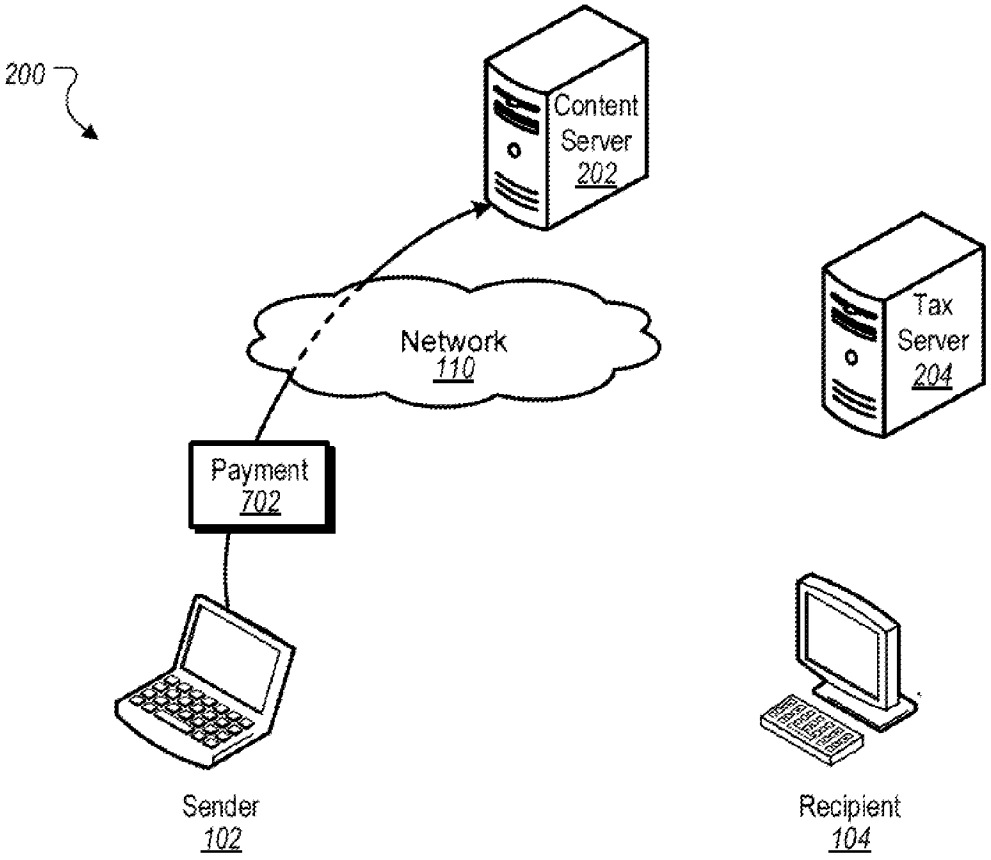
Figure 8:
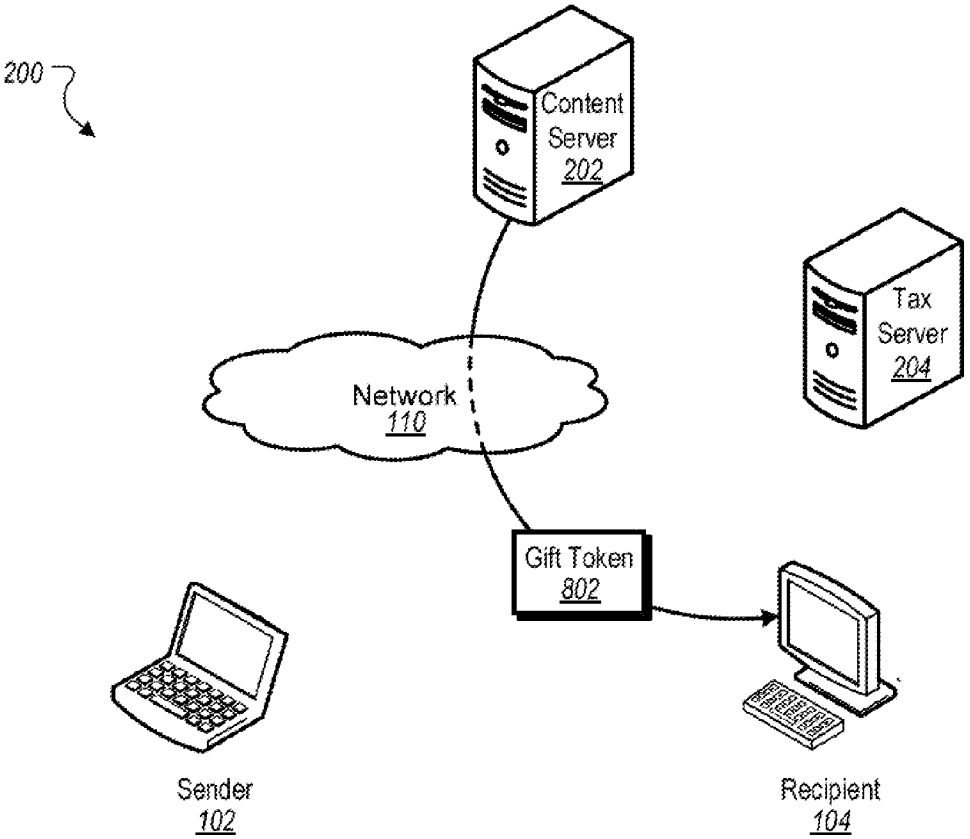

The tax amount is looked up (1022), e.g., by the tax server 1001*c*. Referring to FIG. 4, for example, the tax server 104 can use the location information provided by the sender 102 to look up the tax rate for the jurisdiction that corresponds to the location of the recipient 104. In some cases, the jurisdiction can be associated with taxes of different kinds, such as a location in which a city, county and state all impose a sales tax. In this case, the tax server can sum the tax rates if not already summed for the location.

The tax information is sent to the media server (1024), e.g., by the tax server 1001*c*. For example, referring to FIG. 5, the tax server 108 can provide a tax amount 502 to the content server 202, such as over the network 110. The tax information is received (1026), e.g., by the media/gift server 1001*b* (e.g., the content server 202).

The total cost is calculated (1028), e.g., by the media/gift server 1001*b*. As an example, one or more functions of the gift module 216 can add the amount of the tax to the cost of the gift to compute a total cost. The amount of tax for the gift can be calculated by multiplying the tax rate obtained from the tax server 204 by the purchase cost of the gift.

Payment for the gift is requested (1030), e.g., by the media/gift server 1001*b*. The payment request can cover the total cost, including the cost of the gift plus any tax amount. As an example, referring to FIG. 6, the content server 202 can send a payment request 602 to the sender 102. In some implementations, the payment request may include an option to pay the tax amount. That option may be declined, in which case the recipient may be liable for any tax. In some implementations, the payment request may include an option to pay for the tax along with payment for the gift, or to pay the tax at a later time, e.g., when the gift is redeemed or otherwise used.

The request for payment is received (1032), e.g., by the sender device 1001*a*. For example, the sender 102 can receive a total payment amount that indicates the cost of the gift and the amount of the tax. In some implementations, the tax amount can be broken into individual tax components that originate from various entities (e.g., city, county, state, etc.). In some implementations, the received payment request can be displayed on a user interface screen on the user's computing device. The display can identify the tax rate(s) and tax amount(s) associated with the gift.

Payment is sent (1034), e.g., by the sender device 1001*a*. For example, referring to FIG. 7, the sender 102 can send a payment 702 to the content server 202. In some implementations, sending the payment 702 can be initiated by the user selecting a "Send Payment," "Pay" or other control on a user interface screen on a computing device.

In some implementations, sending payment to the content server 202 can involve one or more intermediate parties, such as online payment systems that debit an account of the payer (e.g., the sender 102) and credit an account of the payee (e.g., the content server 202). In some implementations, payment may be delayed for a short time (e.g., minutes to hours) in order for the payment to be authenticated or approved and to post to various accounts.

Payment is received (1036), e.g., by the media/gift server 1001*b*. For example, referring to FIG. 7, the content server 202 can receive a payment 702 over the network 110, or in a network path that includes the network 110 and one or more intermediate parties.

A gift token is sent (1038), e.g., by the media/gift server 1001*b*. As an example, referring to FIG. 8, the content server 202 can send a gift token 802 to the recipient 104. If the gift token is electronic, for example, the gift token can appear within an email message available to the recipient 104. If the gift token is physical, the content server 202 can mail the gift token to the recipient 104.

The gift token is received (1040), e.g., by the recipient device 1001*d*. As an example, referring to FIG. 8, the recipient 104 can receive the gift token 802 from the content server 202. The gift token 802 can be an item that the recipient 104 can redeem in order to receive the gift or the value of the gift.

Example gift tokens include a card, voucher, coupon, redemption code, or any other physical or electronic token or symbol of the gift.

Figure 9:
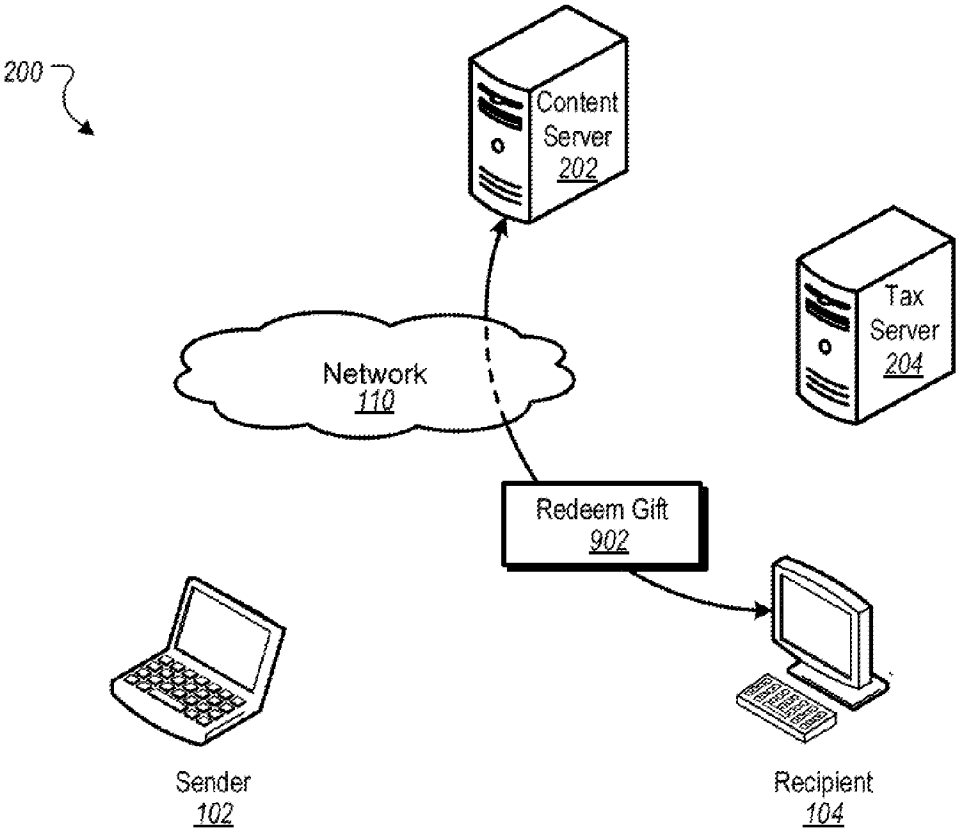

The gift token can be redeemed for the corresponding gift. For example, the recipient 104 can perform a gift redemption 902 by presenting the gift token to the content server 202, and in exchange, receiving the corresponding gift as shown in FIG. 9.

In some implementations, instead of paying the tax amount up front, e.g., at the same time that the cost of the gift is paid, the amount of the tax can be paid later. For example, FIGS. 11A and 11B collectively show an alternative sequence of events in which the sender 102 pays the amount of the tax at the time that the recipient 104 redeems the gift token. Paying the tax at this time can represent another action in the process 1000, e.g., after action 1040 of the recipient device 1001*d* receiving the gift token. For example, payment of the tax can occur as soon as just after the recipient (e.g., the recipient 104) uses the gift token to redeem the gift. Referring to FIG. 9, paying the tax at this time can occur after the recipient 104 exercises the gift redemption 902. This may be done in lieu of prior payment of the tax, the actions for which may be omitted in this case.

Figure 11A:
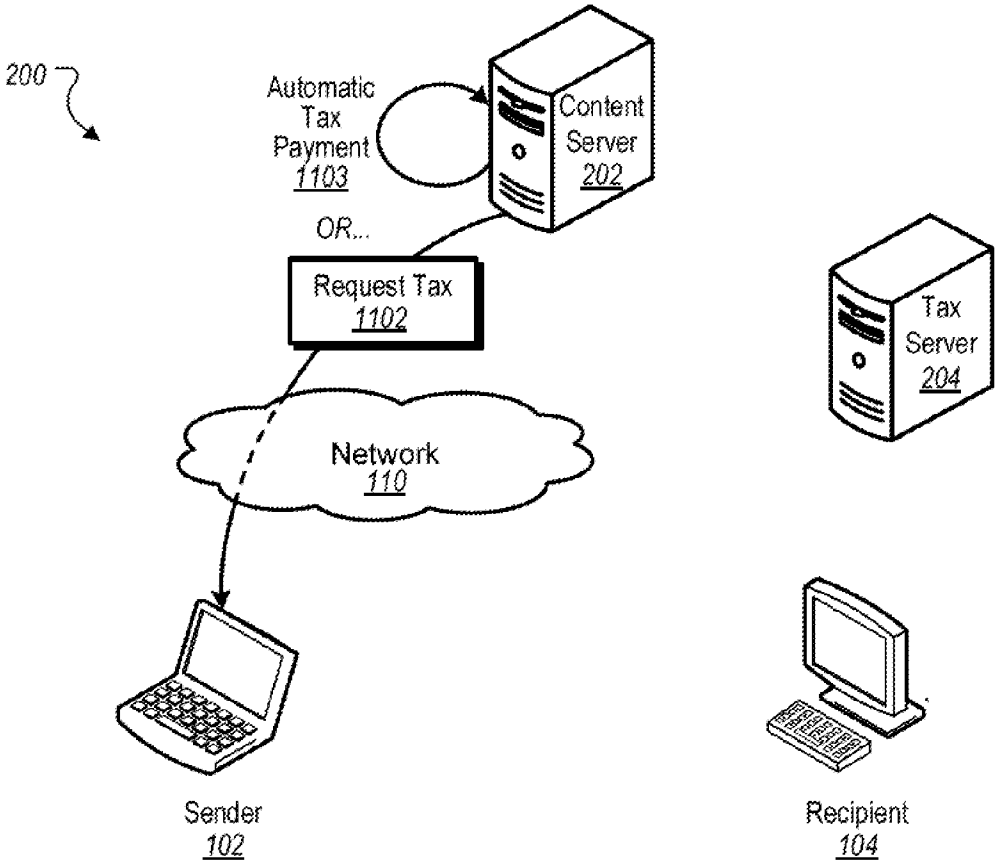
FIGS. 11A and 11B collectively show an alternative sequence of events for paying the amount of tax at gift redemption time.

Referring to FIG. 11A, the content server 202 can send a tax request 1102 to the sender 102, the tax request 1102 corresponding to the tax amount on the gift redeemed by the recipient 104. In some implementations, using user interfaces available at the sender 102, a user can view the amount of tax to be paid, and use some form of payment to pay the tax amount. In some implementations, to collect the amount of tax owed by the sender 102, the content server can automatically access account information that has been pre-established for the sender 102, and automatically charge one of the accounts for the sender 102 for the corresponding tax amount, as shown by arrow 1103. In this example, no additional interaction is required of the sender 102 at the time that the tax amount is paid. In some implementations, for any type of tax payment, one or more user accounts or emails accounts associated with the sender 102 can receive a confirmation message stating that the amount of tax has been paid, including an identification of the tax amount.

Figure 11B:
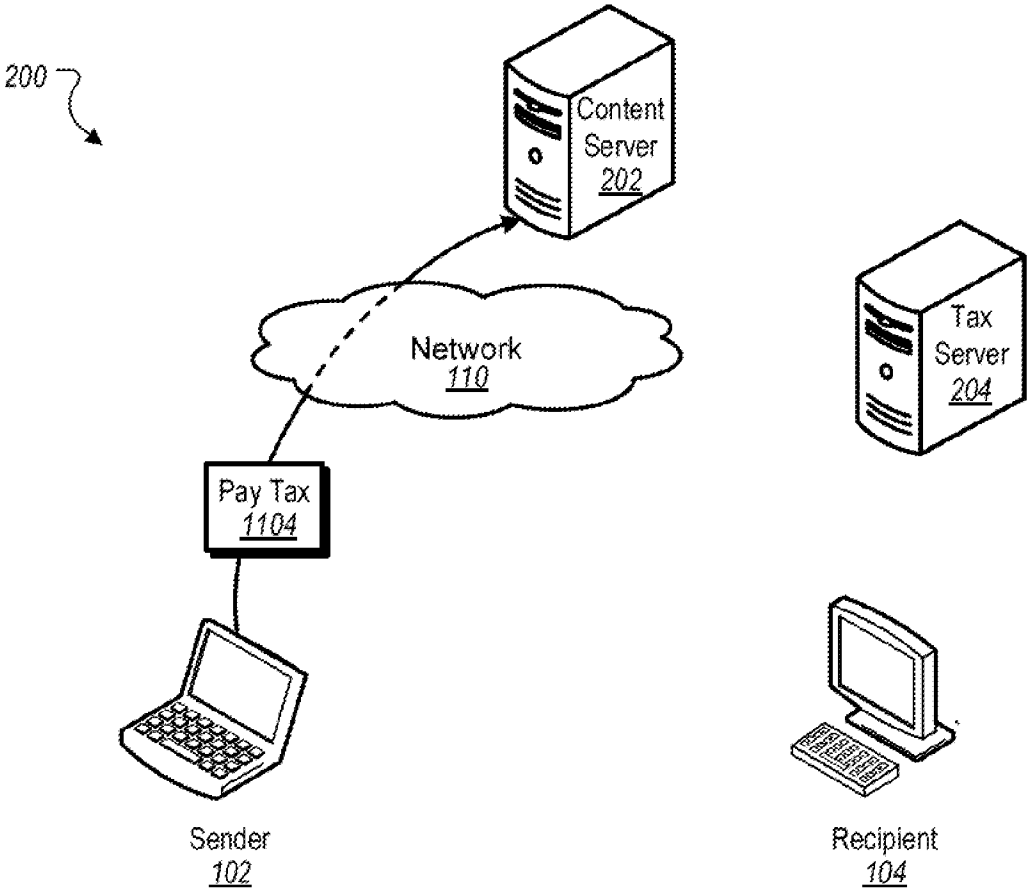

Referring to FIG. 11B, upon receipt of the tax request 1102, the sender 102 can send a tax payment 1104 to the content server 202. The tax payment can be sent, for example, after the user provides payment information on a user interface screen and submits payment, e.g., using a "Send Payment" button or other control.

Figure 12:
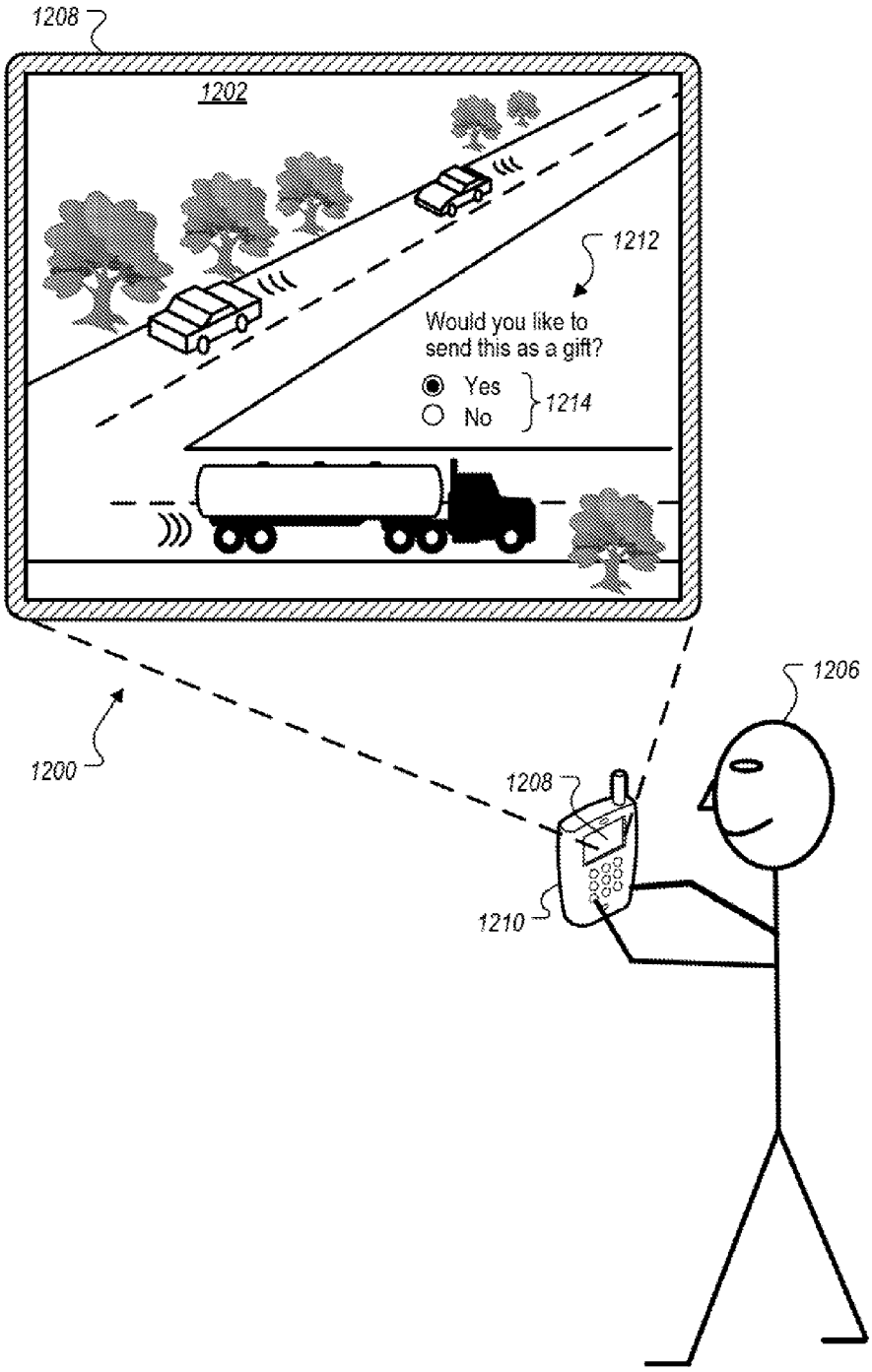
FIGS. 12 and 13 collectively show an example user interface for tax-free gifting of digital content initiated while a user is viewing online media.
Figure 13:
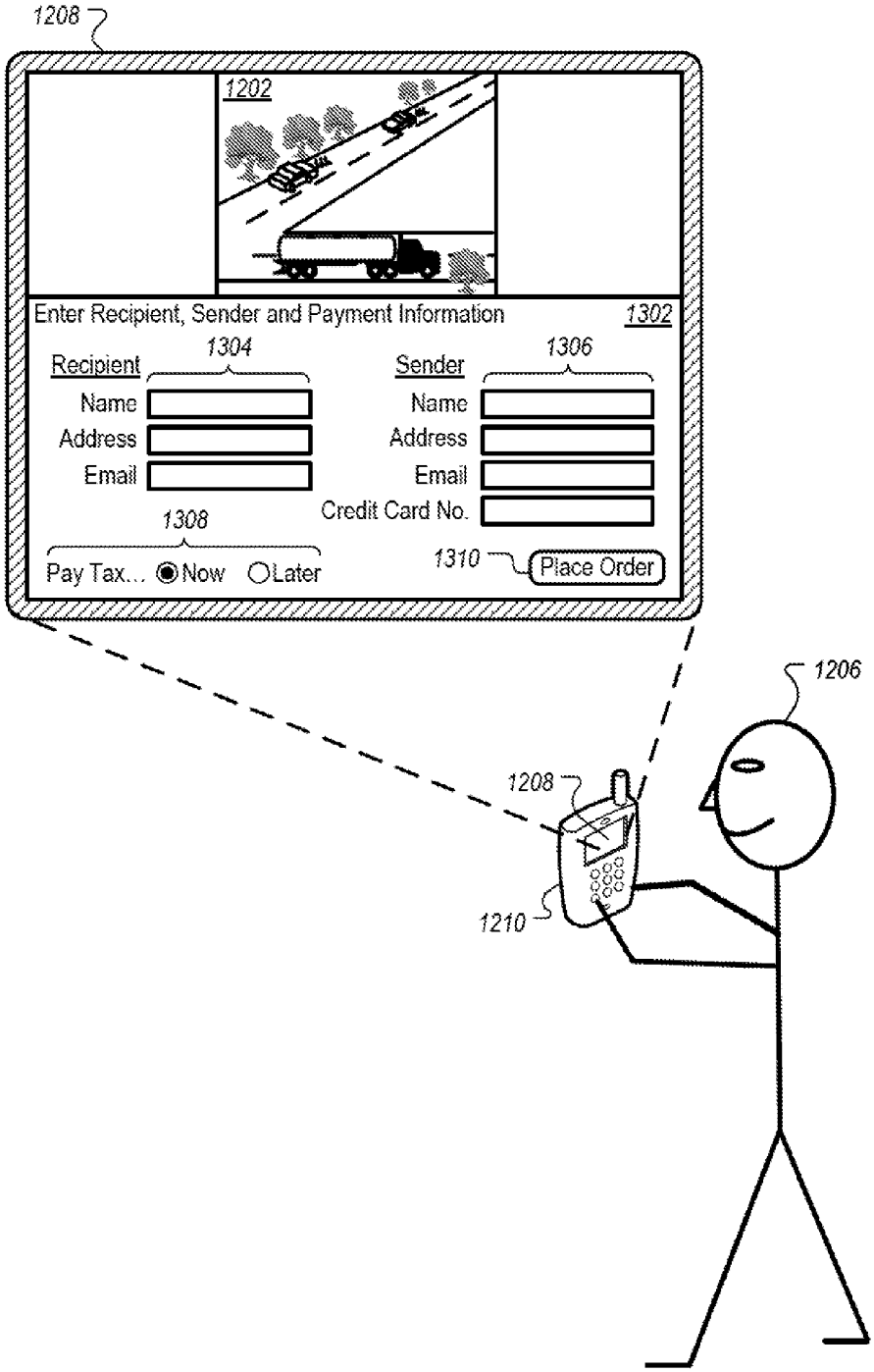

FIGS. 12 and 13 collectively show an example user interface 1200 for tax-free gifting of digital content initiated while a user is viewing online media. For example, the user interface 1200 can display online media (e.g., a movie 1202) that is downloaded or streaming from a web site that sells digital content. A user 1206 may be experiencing the media content for various reasons, such as for pleasure or to review media that may be suitable as a gift for a friend. For example, the user 1206 may be watching the movie 1202 on a screen 1208 of a computer device 1210, such as a laptop, personal computer, smartphone or other mobile computing device. In some implementations, the movie 1202 can be presented using an audio/visual display of the computer device 1210. The movie 1202 presented in this example can correspond to digital content that the user may decide to purchase as a gift, e.g., for the recipient 104.

In some implementations, while the user 1206 is experiencing the online media, for example, a gifting dialog 1212 can appear. For example, the gifting dialog 1212 may appear automatically, such as upon being triggered by the content server 202 after the user has watched the movie for a certain time (e.g., five minutes). In some implementations, the gifting dialog 1212 can appear after the user actively selects a control (e.g., "Buy this as a gift") within the user interface 1200. For example, the control can be available from a toolbar within the user interface 1200.

The gifting dialog 1212, for example, can provide the user 1206 with an option to purchase the digital content corresponding to the movie 1202, e.g., as a gift for a friend. In this example, the purchase option can be displayed on the same display device on which the movie 1202 is output. The gifting dialog 1212 (e.g., "Would you like to send this as a gift?") can include controls 1214 by which the user 1206 can specify gift-giving intent, such as "Yes" and "No" radio buttons. Other implementations of the controls 1214 can include, for example, clickable "Yes . . . " and "No" buttons or some other controls. In some implementations, the controls 1214 can include an "Ask Me Later" control that, if selected, can signal the user interface 1200 to remove the gifting dialog 1212 and re-display it later (e.g., after 10-20 minutes).

Referring to FIG. 13, the user interface 1200 can include an information entry area 1302 for providing recipient, sender and payment information for the purchase of digital content. For example, the information entry area 1302 can be displayed if the user selects the "Yes" option from the controls 1214. In some implementations, when the information entry area 1302 is displayed, the movie 1202 can still be displayed, however in a small area of the screen 1208. In some implementations, the information area 1302 can include the price of the digital content that the user 1206 is in the process of buying.

The information entry area 1302 can include fields for various types of information including, for example, recipient fields 1304 and sender fields 1306 which can include fields for specifying the name, address, and email address of the recipient 104 and sender 102, respectively. The sender fields 1306 can also include one or more fields and/or controls for entering payment information, such as credit card numbers and so on. In some implementations, individual fields can be replaced with clickable buttons or other controls that display and/or accept the input of detailed information. For example, a credit card number field can be implemented instead as a button that displays an interface (e.g., in a popup) in which the user can select from a group of payment options.

In some implementations, the user interface 1200 can include options 1308 for specifying, for example, whether to pay the tax amount on the gift now (e.g., when the gift is purchased) or later (e.g., when the gift token associated with the gift is redeemed). In some implementations, if the user chooses to pay the tax immediately, the user interface 1200 can display a total amount of the gift purchase, including the tax. In some implementations, if the user chooses to delay payment of the tax, the user interface 1200 can display a message indicating the amount of the tax, and optionally, the jurisdiction(s) on which the tax amount is based. For example, the message can say something similar to, "At gift redemption, you will be paying $6.75 which includes 6% Massachusetts state sales tax and 0.75% Anytown municipal sales tax on your $100 gift card purchase."

Upon completion of data entry and tax payment selections in the information entry area 1302, the user can select a place order control 1310, for example, to complete the purchase transaction. When the purchase transaction is complete, a gift token can be issued to the recipient. For example, referring to FIG. 8, the content server 202 can send a gift token 802 to the recipient 104. The recipient 104 can use the gift token 802 to redeem or obtain the gift. As an example, if the gift token corresponds to the movie 1202 that the user 1206 was experiencing and later purchased as a gift, redeeming the gift token can occur online. For example, the user can visit the web site that provides the movies, such as the movie 1202, and by redeeming the gift token 802, the recipient can receive digital content that is a copy of the movie. In some implementations, receipt of the digital content can occur over the network 110. In some implementations, receipt of the digital content can occur by mail. In some implementations, the recipient can use a gift card, printed coupon, or other physical form of the gift token to visit a physical brick-and-mortar location and redeem the gift token there.

Other examples of tax-free gifting of digital content can occur in addition to the online movie example described with reference to FIGS. 12-13. For example, the media content can be audio or some other type(s) of content. In an example of tax-free gifting used for audio content, a user can purchase a gift (e.g., a gift card) redeemable for a certain number of online song downloads (e.g., from iTunes, etc.). When purchasing the gift, the user can also pay the amount of the tax, sparing the recipient of the gift card the cost of paying the tax when the gift card is redeemed. Alternatively, the user can arrange to pay the amount of the tax later on, such as when the gift card is redeemed. For example, when the gift card recipient visits the online song web site to redeem the gift card (and download the songs), the online song web site can trigger an automatic collection from the gift-giving user for the amount of the tax. In some implementations, the amount collected can be obtained from the gift-giving user's credit card or some other per-arranged account or payment method.

In some implementations, some of the mechanisms and processes used for tax-free gifting can also be used for dealing with licensing of digital content that can be tied, for example, to a county or other geographic area. For example, if a sender 102 wants to gift a British song to a British recipient 104, there may be availability issues of where the song can be purchased. To deal with this issue, for example, each country that sells content can have a "country store". As a result, a sender 102 in the US who wants to gift a British song to a British recipient 104 can shop in the UK store. By shopping in the UK store, the jurisdiction of the recipient 104 can be determined automatically, allowing the corresponding tax rate to be applied to calculate the tax. The advantages of using "country stores" in this way can allow transactions to occur without the sender 102 having to know the full tax implications based on country store of the recipient 104.

Figure 14:
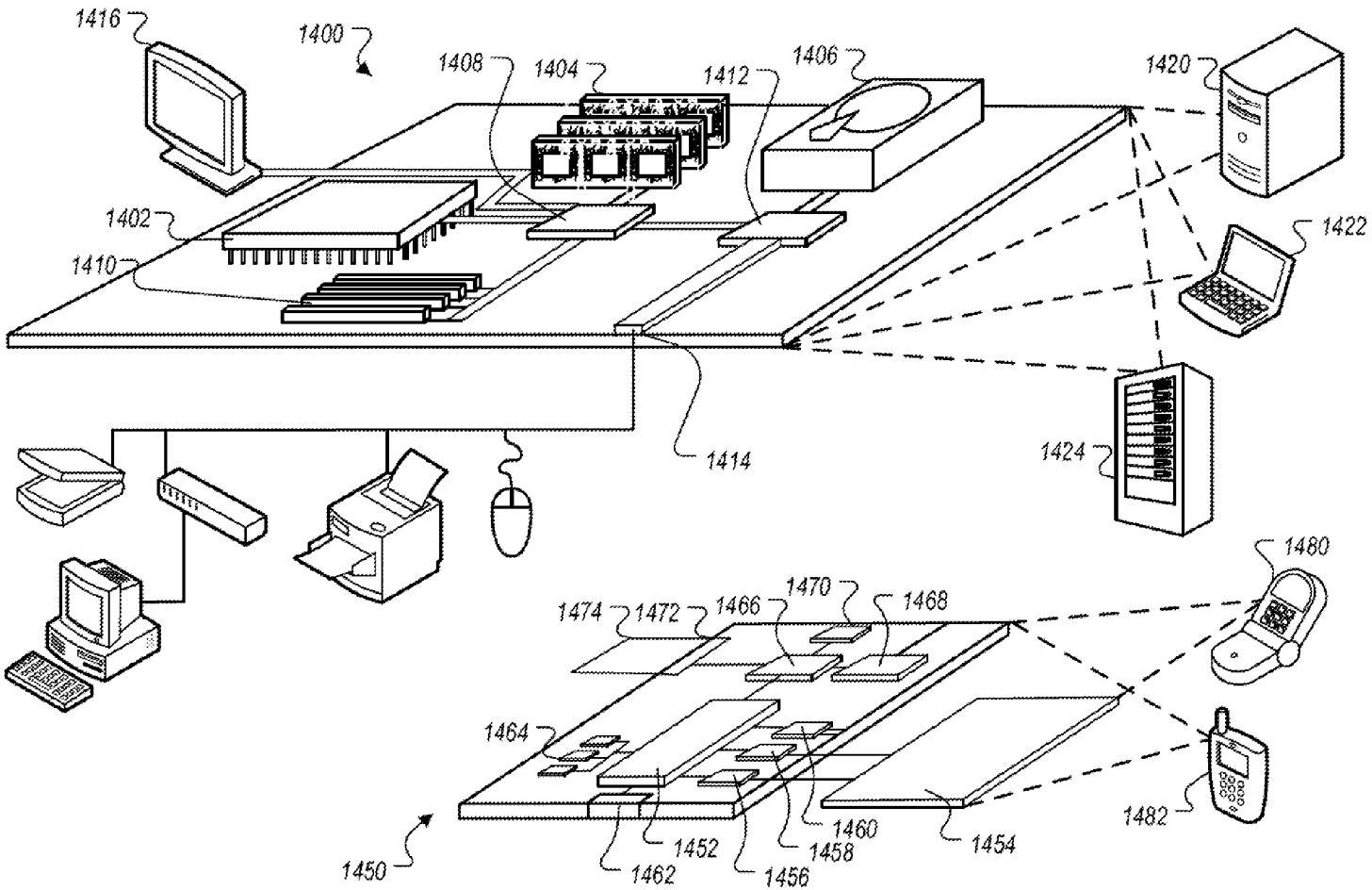
FIG. 14 shows example computer devices.

FIG. 14 shows an example of a generic computer device 1400 and a generic mobile computer device 1450, which may be used to implement the processes described herein, including the mobile-side and server-side processes for installing a computer program from a mobile device to a computer. Computing device 1400 is intended to represent various forms of digital computers, such as laptops, desktops, workstations, personal digital assistants, servers, blade servers, mainframes, and other appropriate computers. Computing device 1450 is intended to represent various forms of mobile devices, such as personal digital assistants, cellular telephones, smartphones, and other similar computing devices. The components shown here, their connections and relationships, and their functions, are meant to be exemplary only, and are not meant to limit implementations of the inventions described and/or claimed in this document.

Computing device 1400 includes a processor 1402, memory 1404, a storage device 1406, a high-speed interface 1408 connecting to memory 1404 and high-speed expansion ports 1410, and a low speed interface 1412 connecting to low speed bus 1414 and storage device 1406. Each of the components 1402, 1404, 1406, 1408, 1410, and 1412 are interconnected using various busses, and may be mounted on a common motherboard or in other manners as appropriate. The processor 1402 can process instructions for execution within the computing device 1400, including instructions stored in the memory 1404 or on the storage device 1406 to display graphical information for a GUI on an external input/output device, such as display 1416 coupled to high speed interface 1408. In other implementations, multiple processors and/or multiple busses may be used, as appropriate, along with multiple memories and types of memory. Also, multiple computing devices 1400 may be connected, with each device providing portions of the necessary operations (e.g., as a server bank, a group of blade servers, or a multi-processor system).

The memory 1404 stores information within the computing device 1400. In one implementation, the memory 1404 is a volatile memory unit or units. In another implementation, the memory 1404 is a non-volatile memory unit or units. The memory 1404 may also be another form of computer-readable medium, such as a magnetic or optical disk.

The storage device 1406 is capable of providing mass storage for the computing device 1400. In one implementation, the storage device 1406 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier may be a non-transitory computer- or machine-readable storage medium, such as the memory 1404, the storage device 1406, or memory on processor 1402.

The high speed controller 1408 manages bandwidth-intensive operations for the computing device 1400, while the low speed controller 1412 manages lower bandwidth-intensive operations. Such allocation of functions is exemplary only. In one implementation, the high-speed controller 1408 is coupled to memory 1404, display 1416 (e.g., through a graphics processor or accelerator), and to high-speed expansion ports 1410, which may accept various expansion cards (not shown). In the implementation, low-speed controller 1412 is coupled to storage device 1406 and low-speed expansion port 1414. The low-speed expansion port 1414, which may include various communication ports (e.g., USB, Bluetooth, Ethernet, wireless Ethernet), may be coupled to one or more input/output devices, such as a keyboard, a pointing device, a scanner, or a networking device such as a switch or router, e.g., through a network adapter.

The computing device 1400 may be implemented in a number of different forms, as shown in the figure. For example, it may be implemented as a standard server 1420, or multiple times in a group of such servers. It may also be implemented as part of a rack server system 1424. In addition, it may be implemented in a personal computer such as a laptop computer 1422. Alternatively, components from computing device 1400 may be combined with other components in a mobile device (not shown), such as device 1450. Each of such devices may contain one or more of computing device 1400, 1450, and an entire system may be made up of multiple computing devices 1400, 1450 communicating with each other.

Computing device 1450 includes a processor 1452, memory 1464, an input/output device such as a display 1454, a communication interface 1466, and a transceiver 1468, among other components. The device 1450 may also be provided with a storage device, such as a microdrive or other device, to provide additional storage. Each of the components 1450, 1452, 1464, 1454, 1466, and 1468 are interconnected using various busses, and several of the components may be mounted on a common motherboard or in other manners as appropriate.

The processor 1452 can execute instructions within the computing device 1450, including instructions stored in the memory 1464. The processor may be implemented as a chipset of chips that include separate and multiple analog and digital processors. The processor may provide, for example, for coordination of the other components of the device 1450, such as control of user interfaces, applications run by device 1450, and wireless communication by device 1450.

Processor 1452 may communicate with a user through control interface 1458 and display interface 1456 coupled to a display 1454. The display 1454 may be, for example, a TFT LCD (Thin-Film-Transistor Liquid Crystal Display) or an OLED (Organic Light Emitting Diode) display, or other appropriate display technology. The display interface 1456 may comprise appropriate circuitry for driving the display 1454 to present graphical and other information to a user. The control interface 1458 may receive commands from a user and convert them for submission to the processor 1452. In addition, an external interface 1462 may be provided in communication with processor 1452, so as to enable near area communication of device 1450 with other devices. External interface 1462 may provide, for example, for wired communication in some implementations, or for wireless communication in other implementations, and multiple interfaces may also be used.

The memory 1464 stores information within the computing device 1450. The memory 1464 can be implemented as one or more of a computer-readable medium or media, a volatile memory unit or units, or a non-volatile memory unit or units. Expansion memory 1474 may also be provided and connected to device 1450 through expansion interface 1472, which may include, for example, a SIMM (Single In Line Memory Module) card interface. Such expansion memory 1474 may provide extra storage space for device 1450, or may also store applications or other information for device 1450. Specifically, expansion memory 1474 may include instructions to carry out or supplement the processes described above, and may include secure information also. Thus, for example, expansion memory 1474 may be provide as a security module for device 1450, and may be programmed with instructions that permit secure use of device 1450. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 1464, expansion memory 1474, memory on processor 1452, or a propagated signal that may be received, for example, over transceiver 1468 or external interface 1462.

Device 1450 may communicate wirelessly through communication interface 1466, which may include digital signal processing circuitry where necessary. Communication interface 1466 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 1468. In addition, short-range communication may occur, such as using a Bluetooth, Wi-Fi, or other such transceiver (not shown). In addition, GPS (Global Positioning System) receiver module 1470 may provide additional navigation- and location-related wireless data to device 1450, which may be used as appropriate by applications running on device 1450.

Device 1450 may also communicate audibly using audio codec 1460, which may receive spoken information from a user and convert it to usable digital information. Audio codec 1460 may likewise generate audible sound for a user, such as through a speaker, e.g., in a handset of device 1450. Such sound may include sound from voice telephone calls, may include recorded sound (e.g., voice messages, music files, etc.) and may also include sound generated by applications operating on device 1450.

The computing device 1450 may be implemented in a number of different forms, as shown in the figure. For example, it may be implemented as a cellular telephone 1480. It may also be implemented as part of a smartphone 1482, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

A number of implementations have been described. Nevertheless, it will be understood that various modifications may be made without departing from the spirit and scope of the invention.

In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

Elements of different implementations described herein may be combined to form other implementations not specifically set forth above. Elements may be left out of the processes, computer programs, Web pages, etc. described herein without adversely affecting their operation. Furthermore, various separate elements may be combined into one or more individual elements to perform the functions described herein.

Other implementations not specifically described herein are also within the scope of the following claims.

What is claimed is:

1. A method performed by one or more processing devices, comprising:

receiving, from a computing device of a first party, a request to purchase a gift for a second party;

issuing the gift to the second party;

receiving information from the second party;

identifying a location of the second party based on the information received from the second party;

determining whether a taxing authority of the second party's location imposes at least one of a tax on a purchase associated with redemption of the gift by the second party or a tax on the receipt of the gift by the second party;

determining an amount of the tax imposed by the taxing authority of the second party's location;

generating, using instructions stored on a storage device, a payment request for the amount of the tax imposed; and transmitting the payment request to the computing device of the first party subsequent to identifying the location of the second party based on information received from the second party so that the first party has an option to pay the tax imposed based on the second party's location.

2. The method of claim 1, further comprising receiving payment for a cost of the gift and the amount of the tax at the same time.

3. The method of claim 1, wherein a cost of the gift is received from the first party at a first time that the gift is purchased, and the amount of the tax is received from the first party at a second time that the gift is redeemed, the first time being different from the second time.

4. The method of claim 1, wherein the location of the second party is identified based on at least one of an Internet Protocol (IP) address of a computing device of the second party, a known location of the second party, an e-mail address of the second party, a mobile phone number of the second party, contact information of the second party, or a SIM card value of the computing device of the second party, which is included in the information received from the second party.

5. The method of claim 1, wherein the gift comprises digital content; and wherein the request to purchase the gift is received while the first party is experiencing media generated from the digital content.

6. The method of claim 1, wherein the gift comprises digital content; and wherein the method further comprises:

outputting media corresponding to the digital content; and making an offer to purchase the digital content while the media is being output, wherein the request to purchase the gift is received while the first party is experiencing media generated from the digital content.

7. The method of claim 1, further comprising making an offer to the computing device of the first party to purchase the gift;

generating a user interface comprising an option to purchase the gift; and displaying the user interface on the computing device of the first party.

8. The method of claim 1, wherein the gift comprises one of a digital asset that is redeemable online, a gift certificate, or currency.

9. The method of claim 1, wherein identifying the location of the second party comprises determining that the second party has accessed a location-specific virtual store.

10. The method of claim 1, wherein the payment request comprises an option to pay the tax when the gift is redeemed.

11. One or more storage devices storing instructions that are executable to perform operations comprising:

receiving, from a computing device of a first party, a request to purchase a gift for a second party;

issuing the gift to the second party;

receiving information from the second party;

identifying a location of the second party based on information received from the second party;

determining whether a taxing authority of the second party's location imposes at least one of a tax on a purchase associated with redemption of the gift by the second party or a tax on the receipt of the gift by the second party;

determining an amount of the tax imposed by the taxing authority of the second party's location;

generating a payment request for the amount of the tax imposed; and transmitting the payment request to the computing device of the first party subsequent to identifying the location of the second party based on information received from the second party so that the first party has an option to pay the tax imposed based on the second party's location.

12. The one or more storage devices of claim 11, wherein:

the gift comprises digital content; and the operations further comprise:

outputting media corresponding to the digital content; and making an offer to purchase the digital content while the media is being output, wherein the request to purchase the gift is received while the first party is experiencing media generated from the digital content.

13. The one or more storage devices of claim 11, wherein the gift comprises one of a digital asset that is redeemable online, a gift certificate, or currency.

14. The one or more storage devices of claim 11, wherein identifying the location of the second party comprises determining that the second party has accessed a location-specific virtual store based on the information received from the second party.

15. An apparatus comprising:

memory for storing instructions; and one or more processing devices for executing the instructions to perform operations comprising:

receiving, from a computing device of a first party, a request to purchase a gift for a second party;

issuing the gift to the second party;

receiving information from the second party;

identifying a location of the second party based on the information received from the second party;

determining whether a taxing authority of the second party's location imposes at least one of a tax on a purchase associated with redemption of the gift by the second party or a tax on the receipt of the gift by the second party;

determining an amount of the tax imposed by the taxing authority of the second party's location;

generating a payment request for the amount of the tax imposed; and transmitting the payment request to the computing device of the first party subsequent to identifying the location of the second party based on information received from the second party so that the first party has an option to pay the tax imposed based on the second party's location.

16. The apparatus of claim 15, wherein:

the gift comprises digital content; and the operations further comprise:

outputting media corresponding to the digital content; and making an offer to purchase the digital content while the media is being output, wherein the request to purchase the gift is received while the first party is experiencing media generated from the digital content.

17. The apparatus of claim 15, wherein the gift comprises one of a digital asset that is redeemable online, a gift certificate, or currency.

18. The apparatus of claim 15, wherein identifying the location of the second party comprises determining that the second party has accessed a location-specific virtual store.

19. The method of claim 1, wherein receiving information from the second party occurs subsequent to issuing the gift to the second party.

20. The method of claim 19, wherein transmitting the payment request to the computing device of the first party occurs subsequent to issuing the gift to the second party.

* * * * *